US011078064B2

(12) United States Patent
Massari et al.

(10) Patent No.: US 11,078,064 B2
(45) Date of Patent: Aug. 3, 2021

(54) FILLING MACHINE FOR HOT FILLING

(71) Applicant: SACMI BEVERAGE S.P.A., Imola (IT)

(72) Inventors: Mirco Massari, Parma (IT); Luigi Marchesi, Collecchio (IT); Aldo Poli, Rivarolo Mantovano (IT)

(73) Assignee: SACMI BEVERAGE S.P.A., Imola (IT)

( * ) Notice: Subject to any disclaimer, the term of this patent is extended or adjusted under 35 U.S.C. 154(b) by 22 days.

(21) Appl. No.: 16/653,088

(22) Filed: Oct. 15, 2019

(65) Prior Publication Data

US 2020/0115209 A1 Apr. 16, 2020

(30) Foreign Application Priority Data

Oct. 16, 2018 (IT) ..... 102018000009471

(51) Int. Cl.
*B67C 3/04* (2006.01)
*B67C 3/16* (2006.01)
(Continued)

(52) U.S. Cl.
CPC ..... *B67C 3/045* (2013.01); *B67C 3/16* (2013.01); *B67C 3/26* (2013.01); *B67C 3/2634* (2013.01);
(Continued)

(58) Field of Classification Search
CPC .. B67C 3/045; B67C 3/26; B67C 3/28; B67C 3/16; B67C 3/2634; B67C 3/24;
(Continued)

(56) References Cited

U.S. PATENT DOCUMENTS 3,090,408 A * 5/1963 Naecker ..... B67C 3/2614 141/57
3,504,822 A * 4/1970 Saloski ..... B65D 7/22 220/203.28
(Continued)

FOREIGN PATENT DOCUMENTS

| | | | |
|---|---|---|---|
| FR | 997417 | A | 1/1952 |
| FR | 1111260 | A | 2/1956 |
| GB | 2098588 | A | 11/1982 |

OTHER PUBLICATIONS

IT Search Report dated Jun. 26, 2019 re: Application No. IT 2018000009471, pp. 1-10, citing: FR 1 111 260 A, GB 2 098 588 A and FR 997 417 A.

*Primary Examiner* — Nicolas A Arnett
(74) *Attorney, Agent, or Firm* — Cantor Colburn LLP

(57) ABSTRACT

A filling machine for the hot filling of containers includes a line for feeding the containers to at least one supporting plate and a line for unloading the filled container from the supporting plate. Above the supporting plate there is a filling head associated with a respective valve assembly to convey the liquid from a containment tank into the container to be filled.

The valve assembly is associated with an internally hollow feeder conduit which accommodates a suction conduit with at least one suction inlet configured to determine the liquid level inside the container.

The filling head includes a sealing element having a first sealing body configured to engage hermetically against the upper edge of the container and is associated with a vent adapted to pass between a position for sealing the chamber for passing liquid from the supply feeder conduit toward the container and a position for venting.

9 Claims, 10 Drawing Sheets

(51) Int. Cl.
*B67C 3/26* (2006.01)
*B67C 3/28* (2006.01)
*B67C 3/24* (2006.01)

(52) U.S. Cl.
CPC ..... *B67C 3/28* (2013.01); *B67C 3/24* (2013.01); *B67C 3/2628* (2013.01); *B67C 3/286* (2013.01); *B67C 2003/2602* (2013.01); *B67C 2003/2657* (2013.01)

(58) Field of Classification Search
CPC ..... B67C 3/2628; B67C 3/286; B67C 2003/2602; B67C 2003/2657
See application file for complete search history.

(56) References Cited

U.S. PATENT DOCUMENTS

| | | | | |
|---|---|---|---|---|
| 5,082,033 | A * | 1/1992 | Weiss | B67C 3/06 141/198 |
| 6,463,964 | B2 * | 10/2002 | Clusserath | B67C 3/065 141/104 |
| 6,470,922 | B2 * | 10/2002 | Sindermann | B67C 3/10 141/37 |
| 6,474,368 | B2 * | 11/2002 | Clusserath | B67C 3/12 141/129 |
| 6,494,238 | B2 * | 12/2002 | Sindermann | B67C 3/222 141/11 |
| 8,459,315 | B2 * | 6/2013 | Clusserath | B67C 3/004 141/90 |
| 9,150,398 | B2 * | 10/2015 | Hartel | B65B 3/326 |
| 9,637,254 | B2 * | 5/2017 | Fahldieck | B67C 3/045 |
| 2010/0108180 | A1 * | 5/2010 | Clusserath | B67C 3/045 141/1 |

* cited by examiner

FILLING MACHINE FOR HOT FILLING

CROSS-REFERENCE TO RELATED APPLICATIONS

This application claims priority to Italian Patent Application No. 102018000009471, filed on Oct. 16, 2018, the contents of which are hereby incorporated by reference in their entirety.

TECHNICAL FIELD

The present disclosure relates to a filling machine, and in particular to a filling machine for hot filling and, in particular, for filling glass containers.

BACKGROUND

A filling machine is a machine intended to be used in plants for filling containers with food-type liquids, such as for example beverages, wines, water, beer or drinks.

Various different types of filling machines for hot filling are known.

Filling machines for food-type liquids have a rotating carousel structure which supports peripherally a plurality of filling heads which are associated with respective valve assemblies, which are adapted to convey the liquid from a containment tank into the containers to be filled.

A first type of machine comprises what are known as "gravity fillers".

The filling technology is of the gravity type with electropneumatic control: each filling valve is enabled for filling by placing it directly on the bottle, but the passage of the product is time-controlled, by way of an electropneumatic valve. The filling level is given by the position where the valve is arranged, inside the bottle.

Such position is determined mechanically by way of adapted spacers (which are specific to each format). During shutdowns of the machine, the product is recirculated, in order to maintain the filling valve at the correct temperature.

In particular, the recirculation does not affect the product in the bottle, but only the product contained in the valve.

The filling time is set on a panel and can be modified as a function of the format and of the requirements of the product being filled.

The known solutions, although widely used, are not however devoid of drawbacks.

Firstly, many filling machines lower and lift the valve with respect to the bottle simultaneously with the pipe for introducing and recirculating the product.

This results in a fairly high risk of contact between the pipe and the bottle.

Furthermore, many of the solutions on the market today lower and lift the entire valve assembly, which has a weight and inertia that are sometimes extremely high, which in some cases limit the speed of the machine itself.

SUMMARY

The aim of the present disclosure is to provide a filling machine for hot filling which is capable of improving the known art in one or more of the above mentioned aspects.

Within this aim, the disclosure provides a filling machine for hot filling which is capable of operating to ensure an extremely precise level of the liquid.

The disclosure also provides a filling machine that is highly reliable, easy to implement and of low cost.

This aim and these and other advantages which will become better apparent hereinafter are achieved by providing a filling machine for hot filling according to the independent claims, optionally provided with one or more characteristics of the dependent claims.

BRIEF DESCRIPTION OF THE DRAWINGS

Further characteristics and advantages of the disclosure will become better apparent from the detailed description that follows of a preferred, but not exclusive, embodiment of the filling machine for hot filling according to the disclosure, which is illustrated for the purposes of non-limiting example in the accompanying drawings wherein.

DETAILED DESCRIPTION OF THE DRAWINGS

Figure 1:
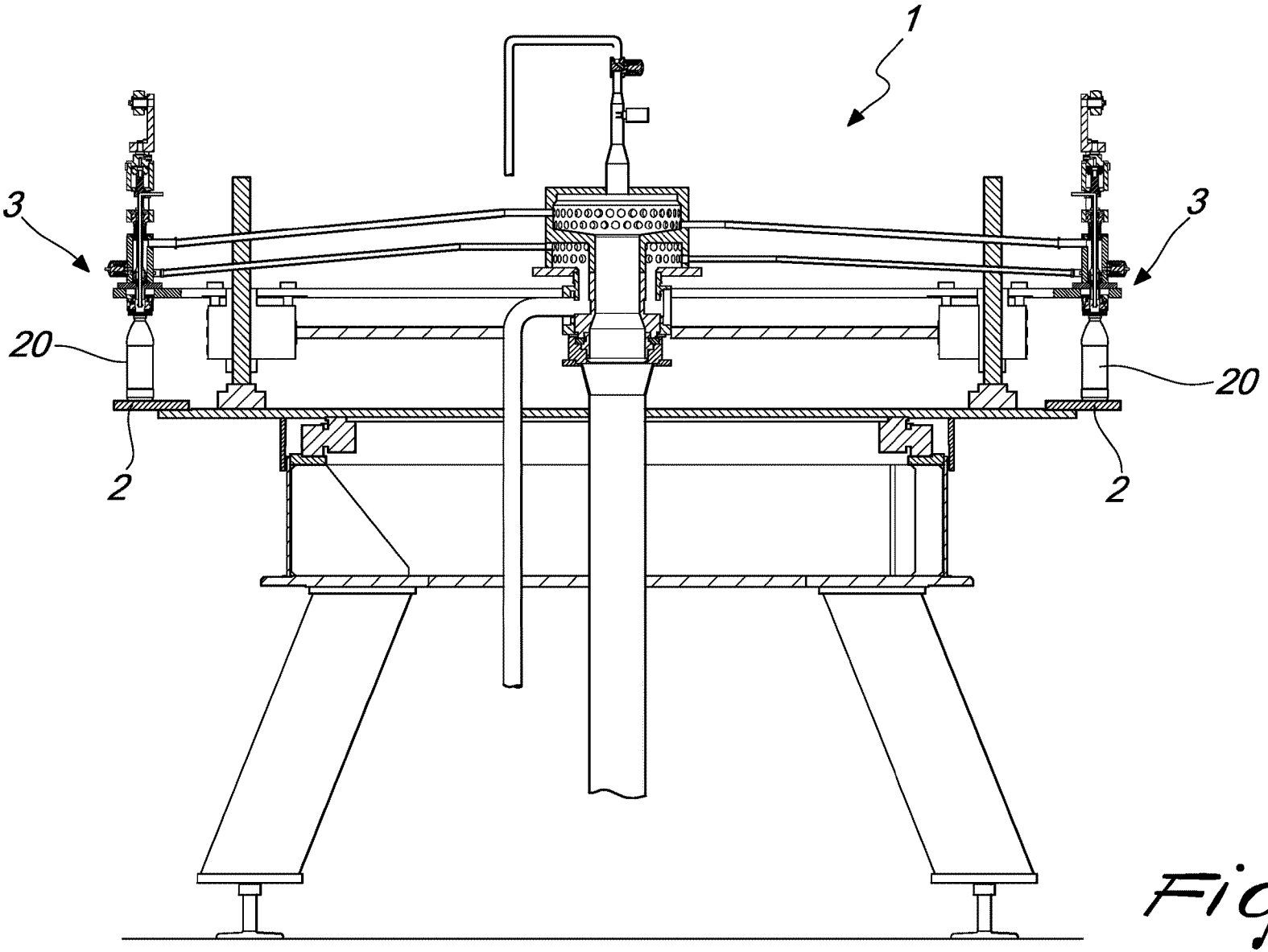
FIG. 1 is a diametrical cross-sectional view of a filling machine according to the disclosure.
Figure 2A:
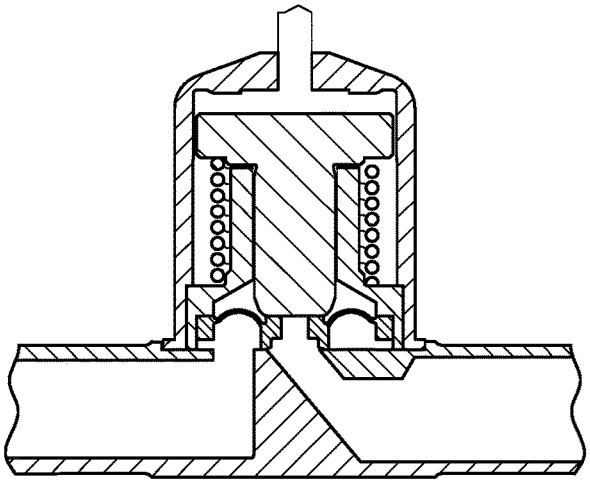
FIG. 2*a* is a transverse cross-sectional view, with respect to the direction of extension of the suction conduit, of the valve assembly in the condition shown in FIG. 2.
Figure 2:
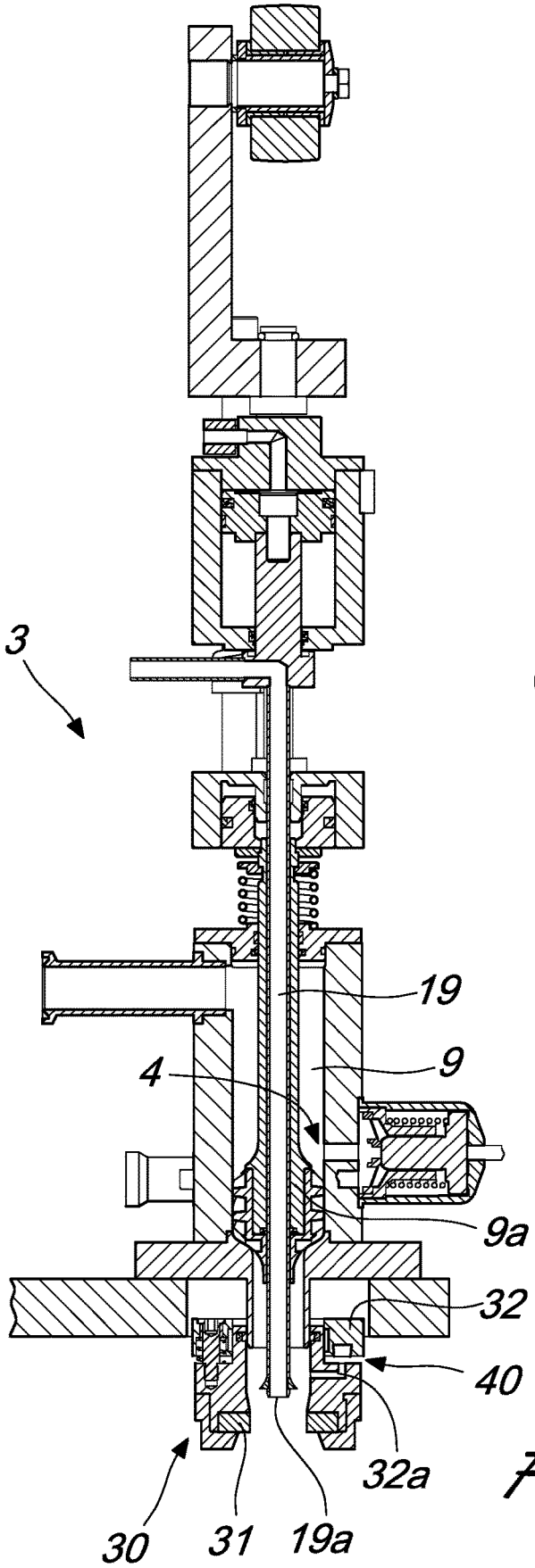
FIG. 2 is a cross-sectional view of a filling head of a filling machine for plastic bottles before positioning the container.
Figure 3:
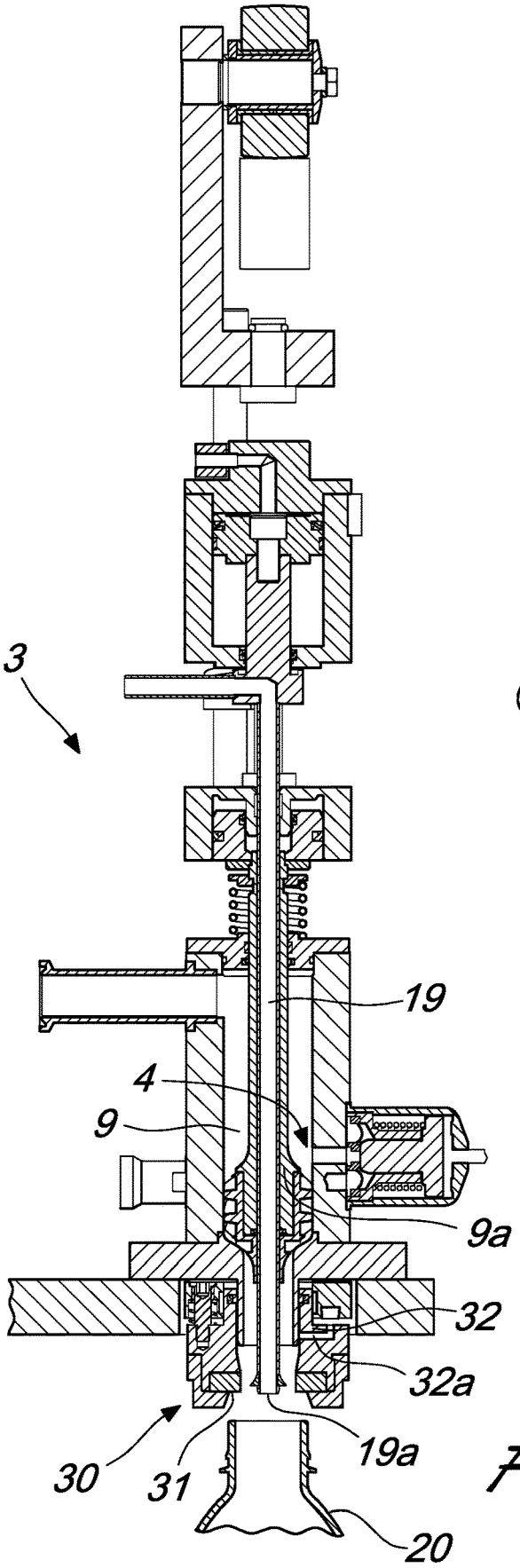
FIG. 3 is a cross-sectional view of a filling head of a filling machine for plastic bottles at the moment of positioning the container.
Figure 3A:
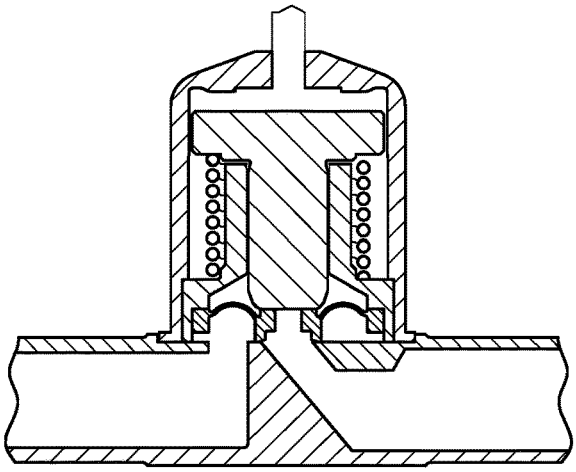
FIG. 3*a* is a transverse cross-sectional view, with respect to the direction of extension of the suction conduit, of the valve assembly in the condition shown in FIG. 3.
Figure 4:
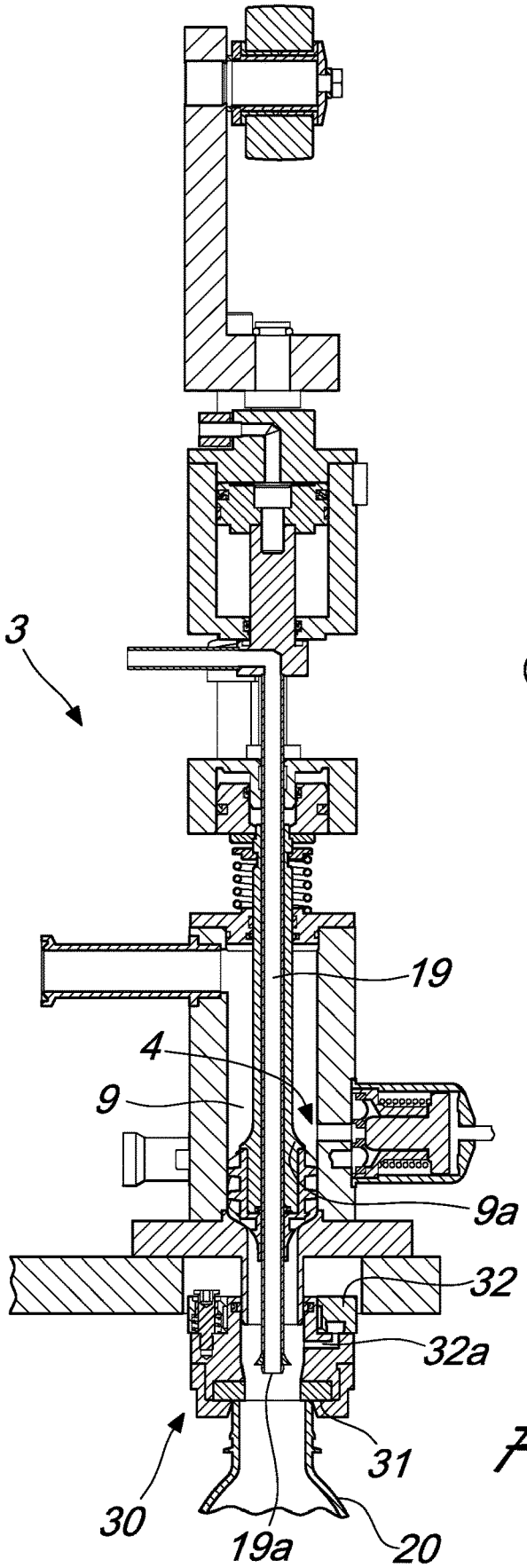
FIG. 4 is a cross-sectional view of a filling head of a filling machine for plastic bottles when the sealing element is brought to form a seal against the upper edge of the container and with the suction conduit in the inactive position.
Figure 4A:
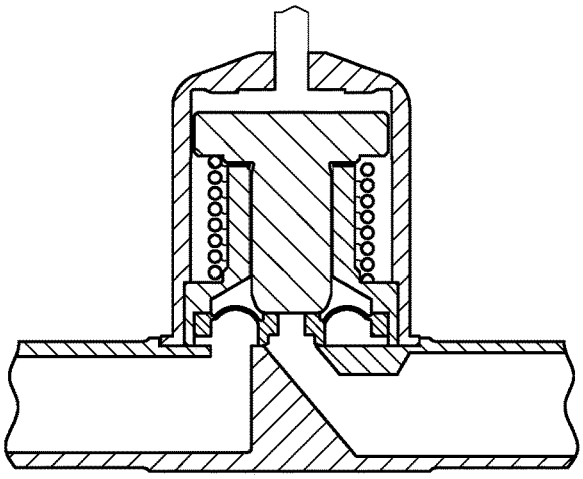
FIG. 4*a* is a transverse cross-sectional view, with respect to the direction of extension of the suction conduit, of the valve assembly in the condition shown in FIG. 4.
Figure 5A:
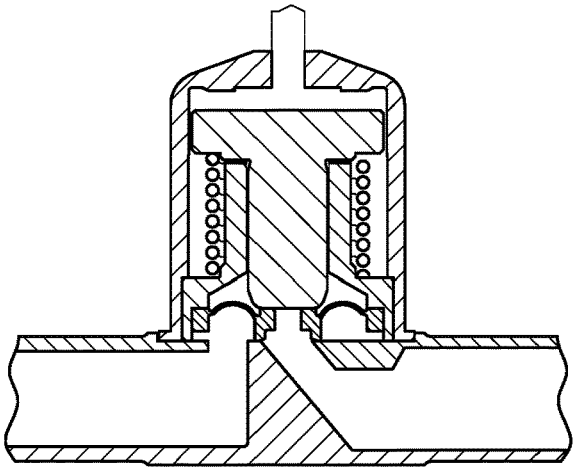
FIG. 5*a* is a transverse cross-sectional view, with respect to the direction of extension of the suction conduit, of the valve assembly in the condition shown in FIG. 5.
Figure 5:
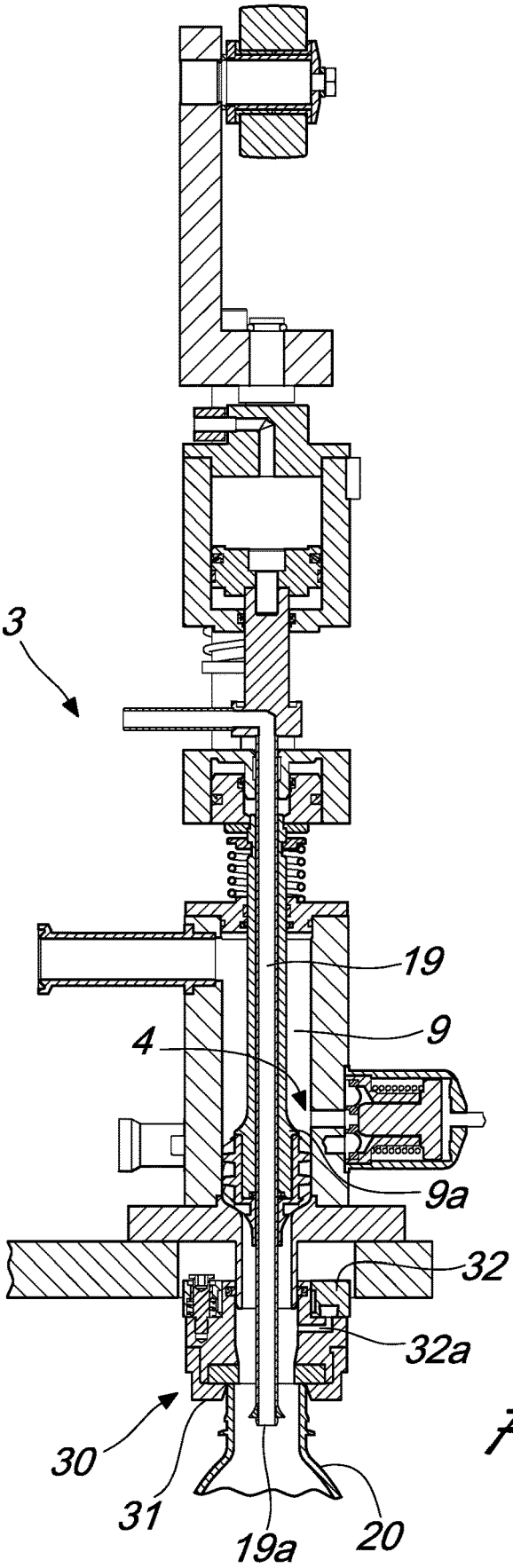
FIG. 5 is a cross-sectional view of a filling head of a filling machine for plastic bottles before positioning the container and with the suction conduit in the active position.
Figure 6:
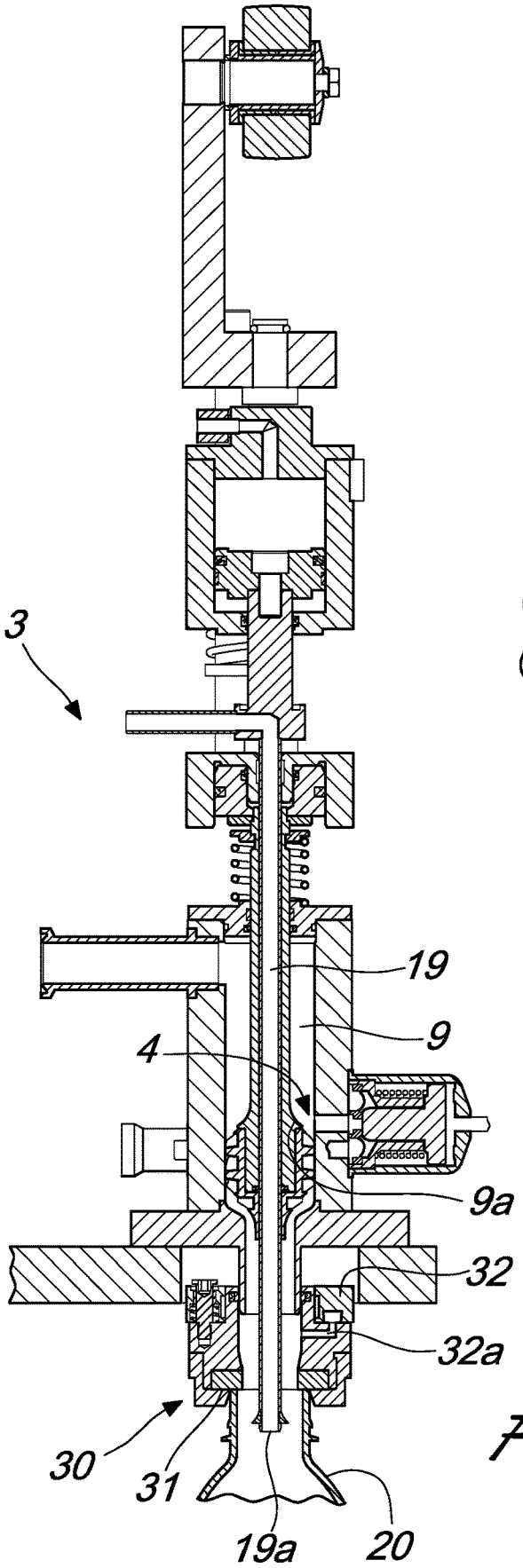
FIG. 6 is a cross-sectional view of a filling head of a filling machine for plastic bottles during the step of filling with the flow control element open.
Figure 6A:
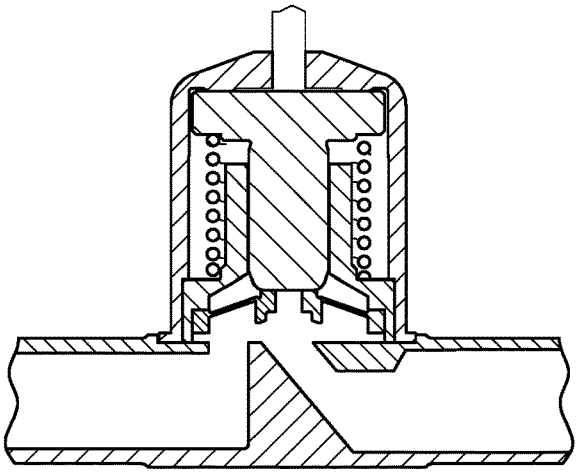
FIG. 6*a* is a transverse cross-sectional view, with respect to the direction of extension of the suction conduit, of the valve assembly in the condition shown in FIG. 6.
Figure 7A:
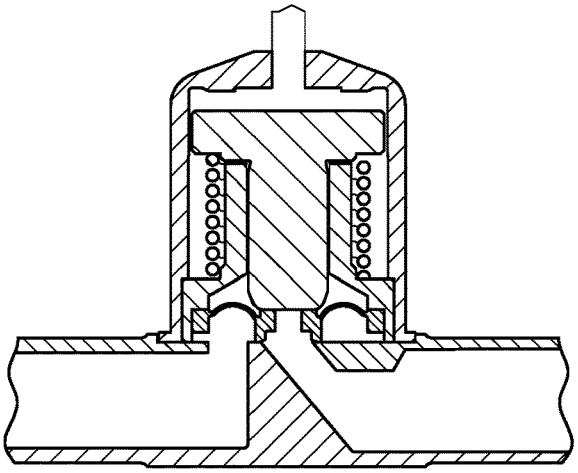
FIG. 7*a* is a transverse cross-sectional view, with respect to the direction of extension of the suction conduit, of the valve assembly in the condition shown in FIG. 7.
Figure 7:
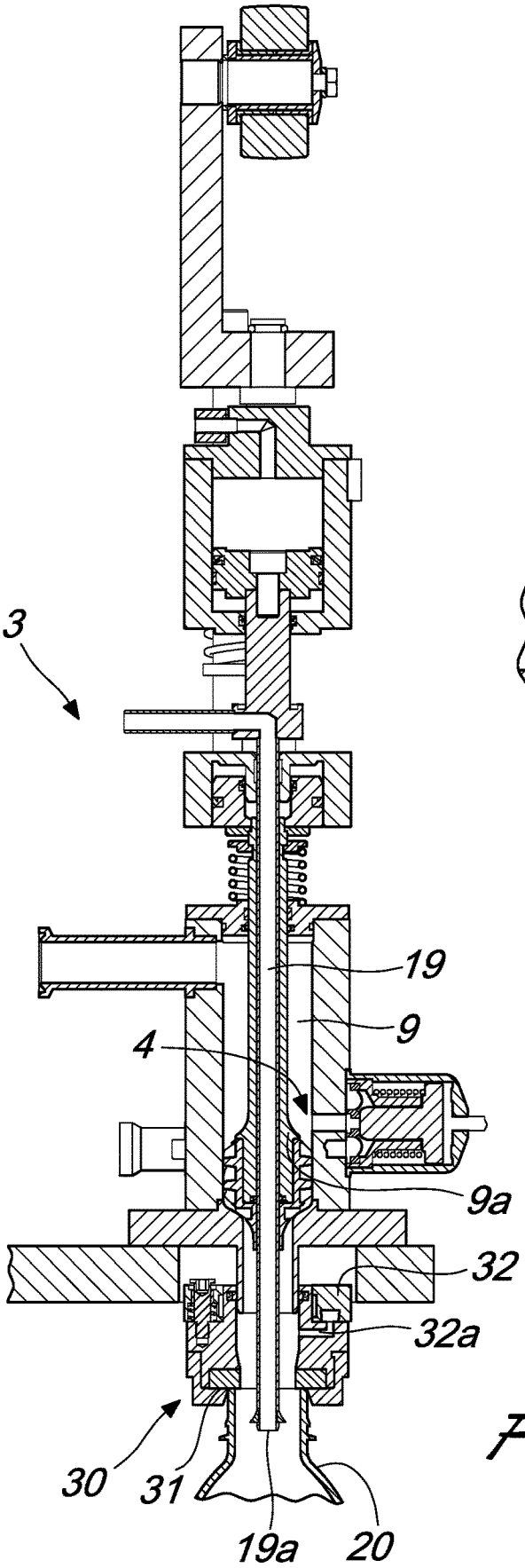
FIG. 7 is a cross-sectional view of a filling head of a filling machine for plastic bottles at the end of the step of filling with the flow control element closed.
Figure 8A:
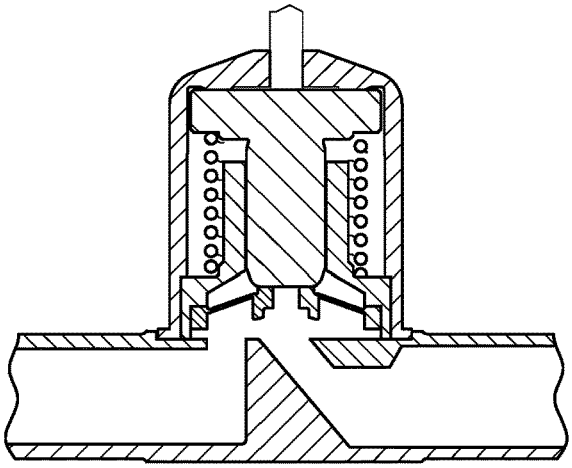
FIG. 8*a* is a transverse cross-sectional view, with respect to the direction of extension of the suction conduit, of the valve assembly in the condition shown in FIG. 8.
Figure 8:
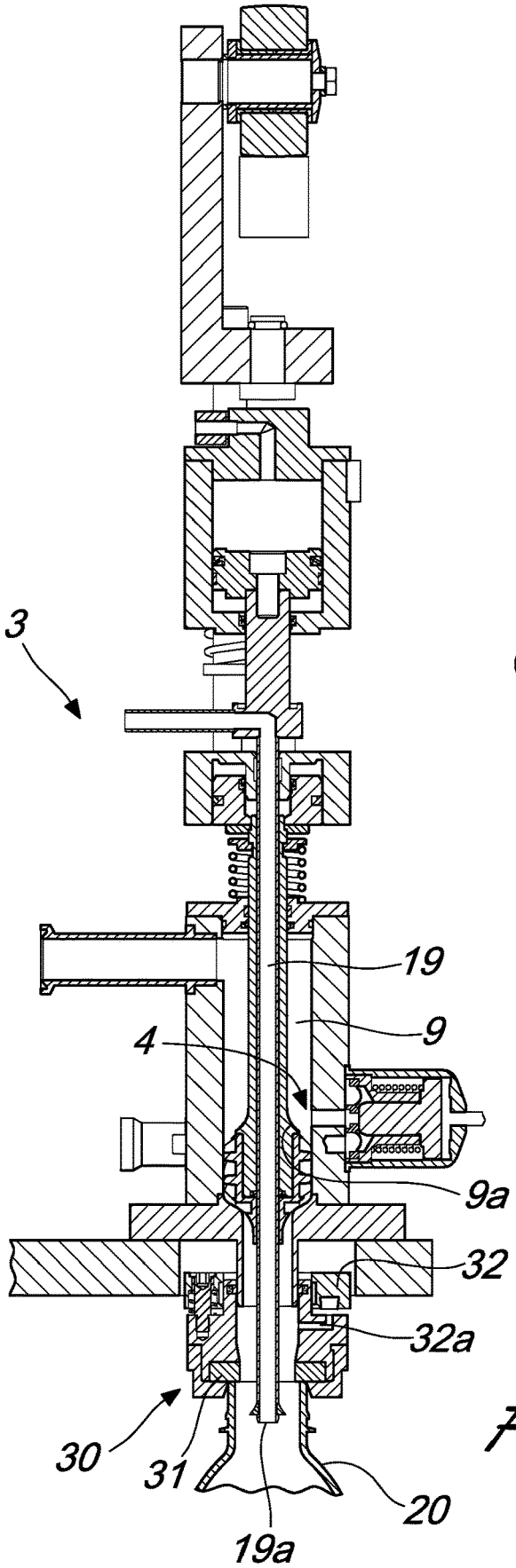
FIG. 8 is a cross-sectional view of a filling head of a filling machine for plastic bottles during the step of suction of the excess liquid.
Figure 9:
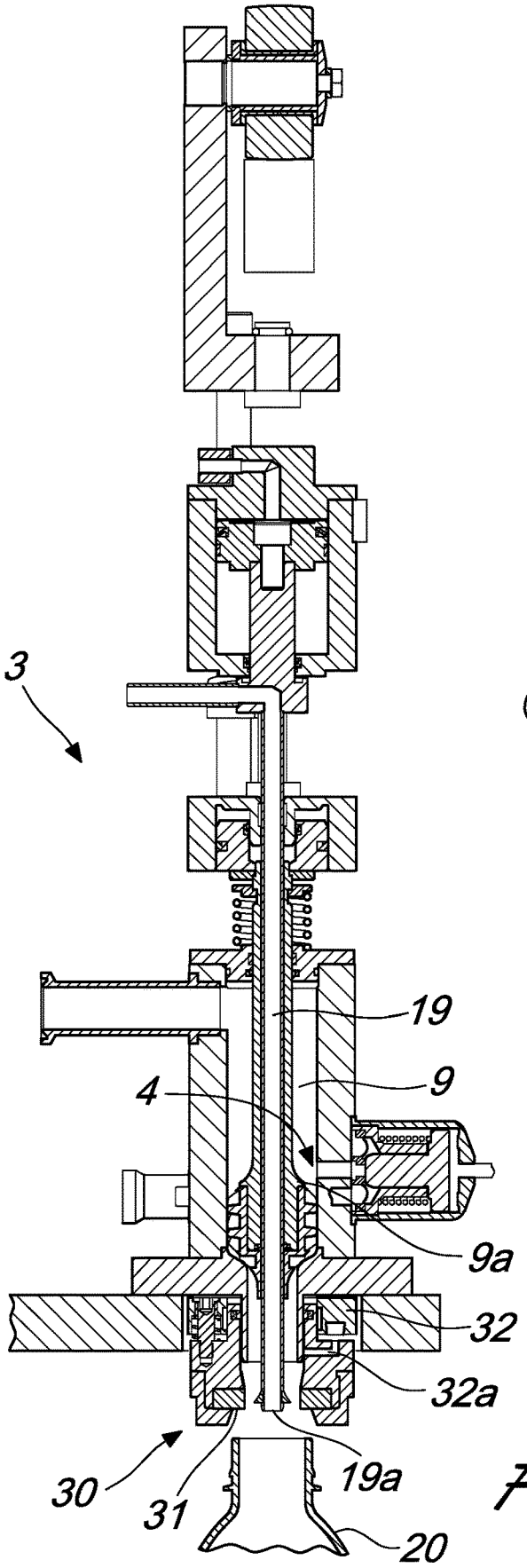
FIG. 9 is a cross-sectional view of a filling head of a filling machine for plastic bottles during the step of disengaging the container from the filling head.
Figure 9A:
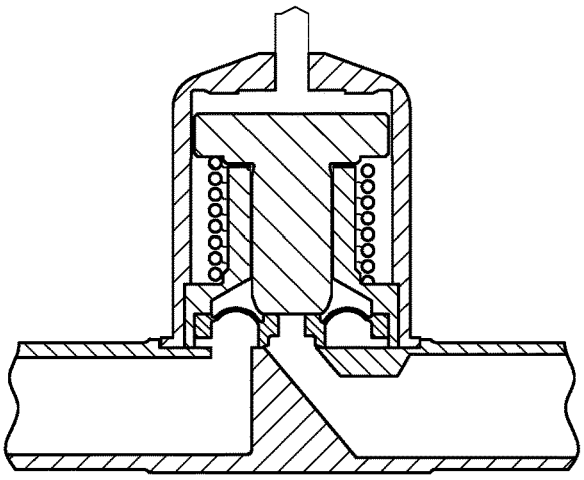
FIG. 9*a* is a transverse cross-sectional view, with respect to the direction of extension of the suction conduit, of the valve assembly in the condition shown in FIG. 9.
Figure 10:
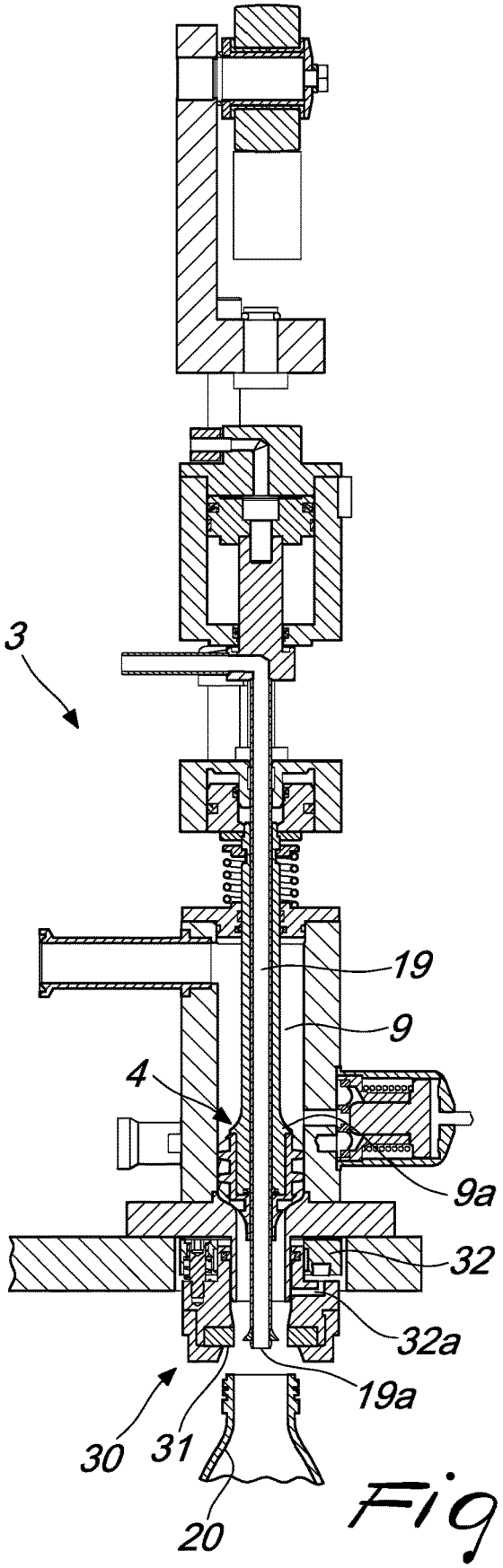
FIG. 10 is a schematic side view of a filling head of a filling machine for glass bottles before positioning the container.
Figure 11:
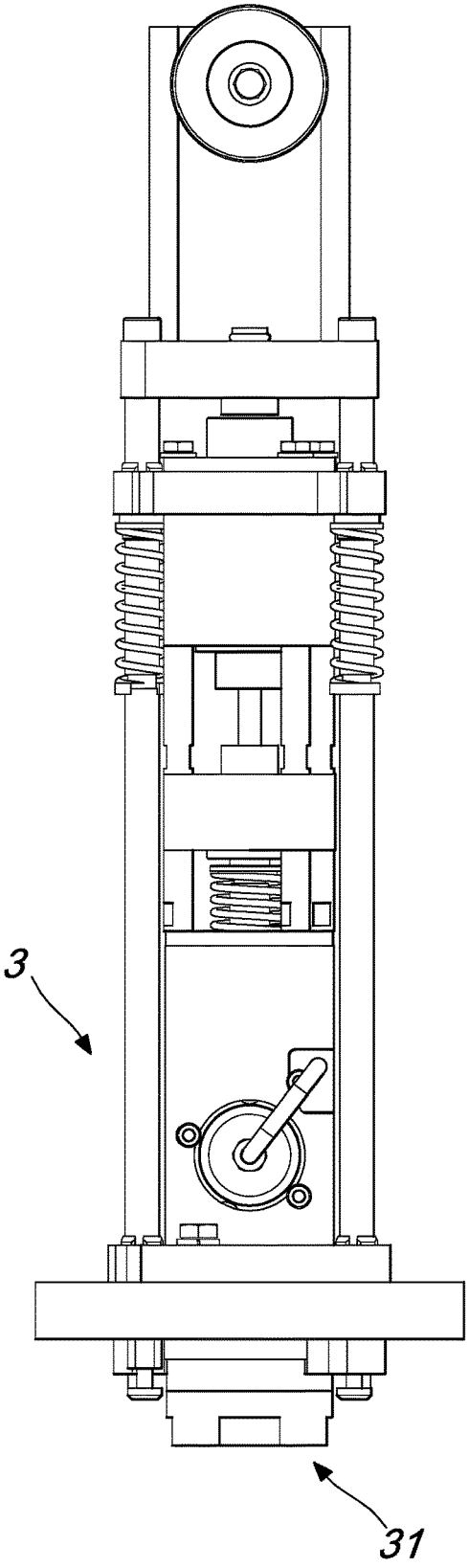
FIG. 11 is a cross-sectional view of a filling head of a filling machine for glass bottles at the moment of positioning the container.

With reference to the figures, the filling machine according to the disclosure, generally designated by the reference numeral 1, for the hot filling of containers 20 with food-type liquids comprises a line for feeding the containers 20 to be filled to at least one supporting plate 2 and a line for unloading the filled container from the supporting plate 2.

Arranged above each supporting plate 2 is a filling head 3, which is associated with a respective valve assembly 4.

The valve assembly 4 is adapted to convey the liquid from a containment tank into the container 20 to be filled, and is associated with an internally hollow feeder conduit 9.

Along at least one section thereof, the feeder conduit 9 is associated with a suction conduit 19 which is provided with at least one suction inlet 19*a* which is designed to determine the level of the liquid inside the container 20.

With reference to the embodiment shown in the figures, the feeder conduit 9 accommodates, along at least one section of its extension, the suction conduit 19.

However, there is no reason why the suction conduit 19 cannot be arranged adjacent to the feeder conduit 9.

The feeder conduit 9 is functionally associated with a flow control element 9*a* which can move on command between a closed condition and an open condition and vice versa.

According to the present disclosure, the filling head 3 comprises a sealing element 30 which has a first sealing body 31 which is designed to engage hermetically against the upper edge of the container 20 and is associated with a vent 40 which is adapted to pass between a position for sealing the chamber for passing liquid from the supply feeder conduit 9 toward the container 20 and a position for venting in which at least one port is defined for the passage of air from the chamber for passing liquid toward the outside.

The filling head 3 is further provided with means for actuating the suction of the liquid from the container by way of the suction conduit 19, which are functionally associated with a device for activating the vent 40 from the position for sealing to the position for venting.

According to a preferred embodiment, the vent comprises a venting body 32 which is associated with the feeder conduit 9 and can move on command with respect to the first sealing body 31 between a position for sealing the chamber for passing liquid from the feeder conduit 9 to the container 20, and a position for venting, in which at least one port 32*a* is defined for the passage of air from the chamber for passing liquid toward the outside.

Advantageously, the device for activating the vent 40 comprises a device for moving the venting body 32 from the position for sealing toward the position for venting.

Such device for activating the vent 40 can further be constituted, for example, by a mechanically-actuated button, by a solenoid valve, by a pneumatic valve etc.

The filling machine 1 is further provided with means for actuating the suction of the excess liquid from the container 20 by way of the suction conduit 19.

In particular, the means for actuating the suction are functionally associated with a device for moving the venting body 32 from the position for sealing to the position for venting.

Conveniently, the filling machine 1 comprises an element for moving the suction conduit 19 between an inactive position, in which it is arranged with its lower edge 19*a* above the lower edge of the first sealing body 31, and an active position, in which the lower edge 19*a* of the suction conduit 19 is arranged below the lower edge of the first sealing body 31.

Advantageously, the filling machine 1 comprises a rotating carousel structure which supports peripherally a plurality of supporting plates 2 above which respective filling heads 3 are arranged.

The filling machine 1 is provided with means for moving the sealing element 30 and the suction conduit 19 in a vertical direction.

Conveniently, the device for moving the venting body 32 from the position for sealing to the position for venting and vice versa comprises a cam device.

According to a preferred embodiment, the element for moving the suction conduit 19 between the inactive position and the active position comprises an actuator of the pneumatic type.

According to a further aspect, the present disclosure relates to a method for filling a container 20 by way of hot filling, which comprises the following steps:

- a step of feeding a container 20 to be filled to a plate 2;
- a step of moving a sealing head 30 which is arranged above the container 20 in order to bring a first sealing body 31 so as to form a seal against the upper edge of the container 20, the sealing head 30 further comprising a vent 40 which is associated with a feeder conduit 9 and is arranged, with respect to the first sealing body 31, in a position for sealing the chamber for passing liquid from the feeder conduit 9 toward the container 20;
- a step of opening a flow control element 9*a* which is arranged along the feeder conduit 9 between a position for closing the feeder conduit 9 and a position for opening the feeder conduit 9;
- a step of evacuation, through a suction conduit 19 which is associated with the feeder conduit 9, of the air contained inside the container;
- a step of closing, after a predetermined period of time, the flow control element 9*a;*
- a step of passing the vent 40 to a position for venting the chamber for passing liquid from the feeder conduit 9 toward the container 20;
- a step of suction of the excess liquid through the suction conduit 19;
- a step of moving the sealing head 30 away from the container 20.

Advantageously, the step of evacuation comprises a step of forced suction, so as to make the filling of the container 20 faster.

Conveniently, before the step of opening the flow control element 9*a*, there is a step of moving the suction conduit 19 from an inactive position, in which its lower edge 19*a* is arranged above the lower edge of the first sealing body 31, toward an active position, in which the lower edge 19*a* of the suction conduit 19 is arranged below the lower edge of the first sealing body 31.

In practice it has been found that the disclosure fully achieves the intended aims and advantages by providing a filling machine 1 that can be used in an extremely practical manner for filling both bottles and cans.

The disclosure thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

What is claimed is:

1. A filling machine for hot filling of containers with liquids, the filling machine comprises: a line for feeding the containers to be filled to at least one supporting plate and a line for unloading the filled container from said supporting plate, above said at least one supporting plate is a filling head associated with a respective valve assembly adapted to convey the liquid from a containment tank into the container to be filled, said valve assembly being associated with a feeder conduit which is internally hollow and is associated with a suction conduit provided with at least one suction inlet configured to determine the level of the liquid inside said container, said feeder conduit being functionally associated with a flow control element, wherein said filling head comprises a sealing element which has a first sealing body configured to engage hermetically against the upper edge of said container and is associated with a vent adapted to pass between a position for sealing a chamber for passing liquid from said supply feeder conduit toward said container and a position for venting in which at least one port is defined for the passage of air from said chamber for passing liquid toward the outside, means being provided for actuating the suction of the liquid from said container by way of said suction conduit which are functionally associated with a device configured for activating said vent from said position for sealing to said position for venting.

2. The filling machine according to claim 1, wherein said vent comprises a venting body associated with the feeder conduit and can move on command with respect to the first sealing body between a position for sealing the chamber for passing liquid from said feeder conduit toward said container and a position for venting, in which at least one port is defined for the passage of air from said chamber for passing liquid toward the outside, said device configured for activating said vent comprising a device configured for moving said venting body from said position for sealing to said position for venting.

3. The filling machine according to claim 2, wherein said device configured for moving said venting body from said position for sealing to said position for venting and vice versa comprises a cam device.

4. The filling machine according to claim 1, further comprising an element for moving said suction conduit between an inactive position, in which said suction conduit is arranged with its lower edge above the lower edge of said first sealing body, and an active position, in which said lower edge of said suction conduit is arranged below the lower edge of said first sealing body.

5. The filling machine according to claim 4, wherein said element for moving said suction conduit between said inactive position and said active position comprises an actuator of the pneumatic type.

6. The filling machine according to claim 1, further comprising a rotating carousel structure which supports peripherally a plurality of said supporting plates, above which respective filling heads are arranged, means being provided for moving said sealing element and said suction conduit in a vertical direction.

7. A method for filling a container by hot filling, the method including the following steps:

feeding a container to be filled to a plate, moving a sealing head which is arranged above said container in order to bring a first sealing body so as to form a seal against the upper edge of said container, said sealing head further comprising a vent which is associated with a feeder conduit and is arranged, with respect to the first sealing body, in a position for sealing a chamber for passing liquid from said feeder conduit toward said container, opening a flow control element which is arranged along said feeder conduit between a position for closing said feeder conduit and a position for opening said feeder conduit, evacuating, through a suction conduit which is arranged at least partially inside said feeder conduit, of the air contained inside said container, closing, after a predetermined period of time, said flow control element, passing said vent to a position for venting the chamber for passing liquid from said feeder conduit toward said container, suction of the liquid by said suction conduit, and moving said sealing head away from said container.

8. The method according to claim 7, wherein said evacuating step includes a step of suction.

9. The method according to claim 7, further including, prior to the step of opening the flow control element, a step of moving said suction conduit from an inactive position, in which the lower edge of said suction conduit is arranged above the lower edge of said first sealing body, to an active position, in which said lower edge of said suction conduit is arranged below the lower edge of said first sealing body.

* * * * *